United States Patent [19]

Tamm et al.

[11] 4,199,432

[45] Apr. 22, 1980

[54] STAGED TURBULENT BED RETORTING PROCESS

[75] Inventors: Paul W. Tamm, Oakland; Gordon E. Langlois, Lafayette, both of Calif.

[73] Assignee: Chevron Research Company, San Francisco, Calif.

[21] Appl. No.: 889,156

[22] Filed: Mar. 22, 1978

[51] Int. Cl.[2] ..... C10G 1/00; C10B 47/24

[52] U.S. Cl. ..... 208/8 R; 208/11 R; 201/31

[58] Field of Search ..... 208/11 R, 8; 201/31

[56] References Cited

U.S. PATENT DOCUMENTS

| | | | |
|---|---|---|---|
| 2,538,219 | 1/1951 | Wely, Jr. | 201/31 X |
| 2,582,712 | 1/1952 | Howard | 208/8 X |
| 2,725,348 | 11/1955 | Martin et al. | 208/11 R X |
| 3,597,327 | 8/1971 | Squires | 208/8 X |
| 3,855,070 | 12/1974 | Squires | 208/8 X |
| 4,064,018 | 12/1977 | Choi | 208/8 X |
| 4,125,453 | 11/1978 | Tamm et al. | 201/31 X |

*Primary Examiner*—Delbert E. Gantz
*Assistant Examiner*—William G. Wright
*Attorney, Agent, or Firm*—D. A. Newell; R. H. Davies; R. H. Evans

[57] ABSTRACT

A continuous process is disclosed for the retorting of shale and other similar hydrocarbon-containing solids of a broad particle size distribution in which the solids to be retorted are introduced into an upper portion of an elongated vessel with a solid heat transfer material at an elevated temperature. The hydrocarbon-containing solids and heat transfer material, a portion of each being fluidized, pass downwardly through the retort under substantially plug-flow conditions, countercurrent to an upwardly flowing stripping gas. Retorted solids and heat transfer material are withdrawn from the bottom of the retort vessel and a product stream of hydrocarbon vapors mixed with stripping gas is recovered overhead.

17 Claims, 2 Drawing Figures

STAGED TURBULENT BED RETORTING PROCESS

BACKGROUND OF THE INVENTION

1. Field of the Invention

The present invention relates to the retorting of hydrocarbon-containing solids of a broad particle size distribution, a portion of said solids being fluidized during said retorting.

2. Description of the Prior Art

Vast natural deposits of shale in Colorado, Utah and Wyoming contain appreciable quantities of organic matter which decomposes upon pyrolysis to yield oil, hydrocarbon gases and residual carbon. The organic matter or kerogen content of said deposits has been estimated to be equivalent to approximately 4 trillion barrels of oil. As a result of the dwindling supplies of petroleum and natural gas, extensive ranch efforts have been directed to develop retorting processes which will economically produce shale oil on a commercial basis from these vast resources.

In principle, the retorting of shale and other similar hydrocarbon-containing solids simply comprises heating the solids to an elevated temperature and recovering the vapors evolved. However, as medium grade oil shale yields approximately 25 gallons of oil per ton of shale, the expense of materials handling is critical to the economic feasibility of a commercial operation. The choice of a particular retorting method must therefore take into consideration the raw and spent materials handling expense, as well as product yield and process requirements.

Process heat requirements may be supplied either directly or indirectly. Directly heated retorting processes rely upon the combustion of fuel in the presence of the oil shale to provide sufficient heat for retorting. Such processes result in lower product yields due to unavoidable combustion of some of the product and dilution of the product stream with the products of combustion. Indirectly heated retorting processes, however, generally use a separate furnace or equivalent vessel in which a solid or gaseous heat carrier medium is heated. The hot heat carrier is subsequently mixed with the hydrocarbon-containing solids to provide process heat, thus resulting in higher yields while avoiding dilution of the retorting product with combustion products, but at the expense of additional materials handling. The indirectly heated retort systems which process large shale or which use a gaseous heat transfer medium generally have lower throughputs per retort volume than the systems wherein smaller shale is processed or solid heat carriers are used.

In essentially all above-ground processes for the retorting of shale, the shale is first crushed to reduce the size of the shale to aid in materials handling and to reduce the time required for retorting. Many of the prior art processes, typically those processes which use moving beds, cannot tolerate excessive amounts of shale fines whereas other processes, such as the entrained bed retorts, require that all of the shale processed be of relatively small particle size, and still other processes, such as those using fluidized beds, require the shale to be of uniform size as well as being relatively small. Unfortunately, crushing operations have little or no control over the breadth of the resultant size distribution, as this is primarily a function of the rock properties. Thus, classification of the crushed shale to obtain the proper size distribution is normally required prior to retorting in most of the existing prior art processes and, in the absence of multiple processing schemes, a portion of the shale must be discarded.

In certain indirectly heated prior art retorts the hot heat carrier and shale are mechanically mixed in a horizontally inclined vessel. This mechanical mixing often results in high-temperature zones conducive to undesirable thermal cracking and/or low temperature zones which result in incomplete retorting. Furthermore, as solids gravitate to the lower portion of the vessel, stripping the retorted shale with gas is inefficient and results in lower product yields due to readsorption of a portion of the evolved hydrocarbons by the retorted solids.

Prior art fluidized bed retorts have the advantages of uniform mixing and excellent solids to solids contacting over the mechanically mixed retorts; however, there is little control over the individual particle residence time. Thus, in such processes partially retorted material is necessarily removed with the retorted solids, leading to either costly separation and recycle of partially retorted materials, lowered product yields, or use of larger retort volumes. Furthermore, the gross mixing attained in such retorts results in poor stripping and readsorption of the product by the retorted solids. It must also be noted that it is very difficult to maintain a conventional stable fluidized bed of shale without extensive classification efforts to obtain relatively uniform particle sizes.

The process of the present invention avoids many of the disadvantages of the prior art processes referred to above while enabling efficient retorting of hydrocarbon-containing solids having a broad particle size distribution.

SUMMARY OF THE INVENTION

In accordance with the present invention there is provided, in a process wherein fresh hydrocarbon-containing solid particles are retorted by passing said particles into an upper portion of a vertically elongated retort and downwardly therethrough, heating said fresh hydrocarbon-containing solid particles in said retort to retorting temperatures sufficiently high to drive off hydrocarbonaceous materials from said fresh hydrocarbon-containing solid particles, removing said hydrocarbonaceous materials from an upper portion of said retort, and withdrawing the resulting retorted particles from a lower portion of said retort, the improvement which comprises:

(a) maintaining a non-oxidizing atmosphere in said retort;

(b) accomplishing said heating of said fresh hydrocarbon-containing particles primarily by heat transfer to said fresh hydrocarbon-containing particles of heat from hot solid heat carrier particles;

(c) passing said hot solid heat carrier particles into an upper portion of said retort;

(d) passing a non-oxidizing gas upwardly through said retort from a lower portion thereof, at a gas velocity between 1 foot/- second and 5 feet/second;

(e) maintaining the size of both said fresh hydrocarbon-containing particles and said heat carrier particles passed into said retort in a size range which includes particles which are fluidizable at said gas velocity and particles which are non-fluidizable at said gas velocity;

(f) passing said fluidizable fresh hydrocarbon-containing particles and said fluidizable heat carrier particles downwardly through said retort as a downwardly moving columnar bed of particles fluidized by and in countercurrent contact with said upwardly passing gas, at a first rate low enough for the residence time of said fluidizable particles in said retort to be at least sufficient for substantially complete retorting of said fluidizable fresh hydrocarbon-containing particles in said retort;

(g) passing said non-fluidizable fresh hydrocarbon-containing particles and said non-fluidizable heat carrier particles downwardly through said retort and through said columnar bed of particles in countercurrent contact with said upwardly passing gas, at a second rate faster than said first rate and slow enough for the residence time of said non-fluidizable fresh hydrocarbon-containing particles in said retort to be sufficient for at least substantial retorting of said non-fluidizable fresh hydrocarbon-containing particles in said retort;

(h) substantially limiting backmixing and slugging of the fluidizable and non-fluidizable particles in said retort;

(i) withdrawing from an upper portion of said retort said gas in admixture with hydrocarbonaceous materials driven from said fresh hydrocarbon-containing particles in said retort and stripped from the retorted hydrocarbon-containing particles by said gas; and (j) withdrawing from said lower portion of the retort effluent solids including said resulting retorted hydrocarbon-containing particles and said heat carrier particles.

Further in accordance with the present invention, said backmixing and slugging are limited by passing the fluidizable and non-fluidizable particles through a plurality of dispersers disposed in the retort interior. Said dispersers may include rods, perforated plate separators or screens transversely disposed in said retort at spaced intervals or packing substantially filling said retort.

Further in accordance with the present invention, the residence time of the non-fluidizable particles is increased to 50–90% of the average residence time for all particles passing through the retort.

While the invention is not limited thereto, hydrocarbon-containing particles may include shale, gilsonite and coal and the heat carrier may be sand or other inert solids, previously retorted hydrocarbon-containing particles or mixtures of said sand, inert solids and hydrocarbon-containing particles. The non-oxidizing gas used to strip the evolved hydrocarbons from the retorted particles and as a fluidizing medium is preferably steam, hydrogen, inert gas or overhead gas withdrawn from said retort and recycled thereto.

Further in accordance with the invention residual carbon on effluent retorted particles passing from the retort is combusted in a separate combustion zone with an oxygen-containing gas to heat said retorted particles and any inert particles present. The heated particles may then be recycled to the retort to provide process heat for retorting the raw hydrocarbon-containing particles.

Still further in accordance with the invention, the retort is preferably of sufficient length to provide the equivalent of a series of at least two and normally four perfectly mixed stages to promote efficient stripping and solids contacting.

DETAILED DESCRIPTION OF THE INVENTION AND PREFERRED EMBODIMENTS

A. Terms and Introduction

While the process of the present invention is described hereinafter with particular reference to the processing of oil shale, it will be apparent that the process can also be used to retort other hydrocarbon-containing solids such as gilsonite, peat, coal, mixtures of two or more of these materials, or any other hydrocarbon-containing solids with inert materials.

As used herein, the term "oil shale" refers to fine-grained sedimentary inorganic material which is predominantly clay, carbonates and silicates in conjunction with organic matter composed of carbon, hydrogen, sulfur and nitrogen, called "kerogen".

The term "retorted hydrocarbon-containing particles" as used herein refers to the hydrocarbon-containing solids from which essentially all of the volatizable hydrocarbons have been removed, but which may still contain residual carbon.

The term "spent shale" as used herein refers to retorted shale from which a substantial portion of the residual carbon has been removed, for example by combustion in a combustion zone.

The terms "condensed", "noncondensable", "normally gaseous", or "normally liquid" are relative to the condition of the subject material at a temperature of 77° F. (25° C.) and a pressure of one atmosphere.

Particle size, unless otherwise indicated, is measured with respect to Tyler Standard Sieve sizes.

Figure 1:
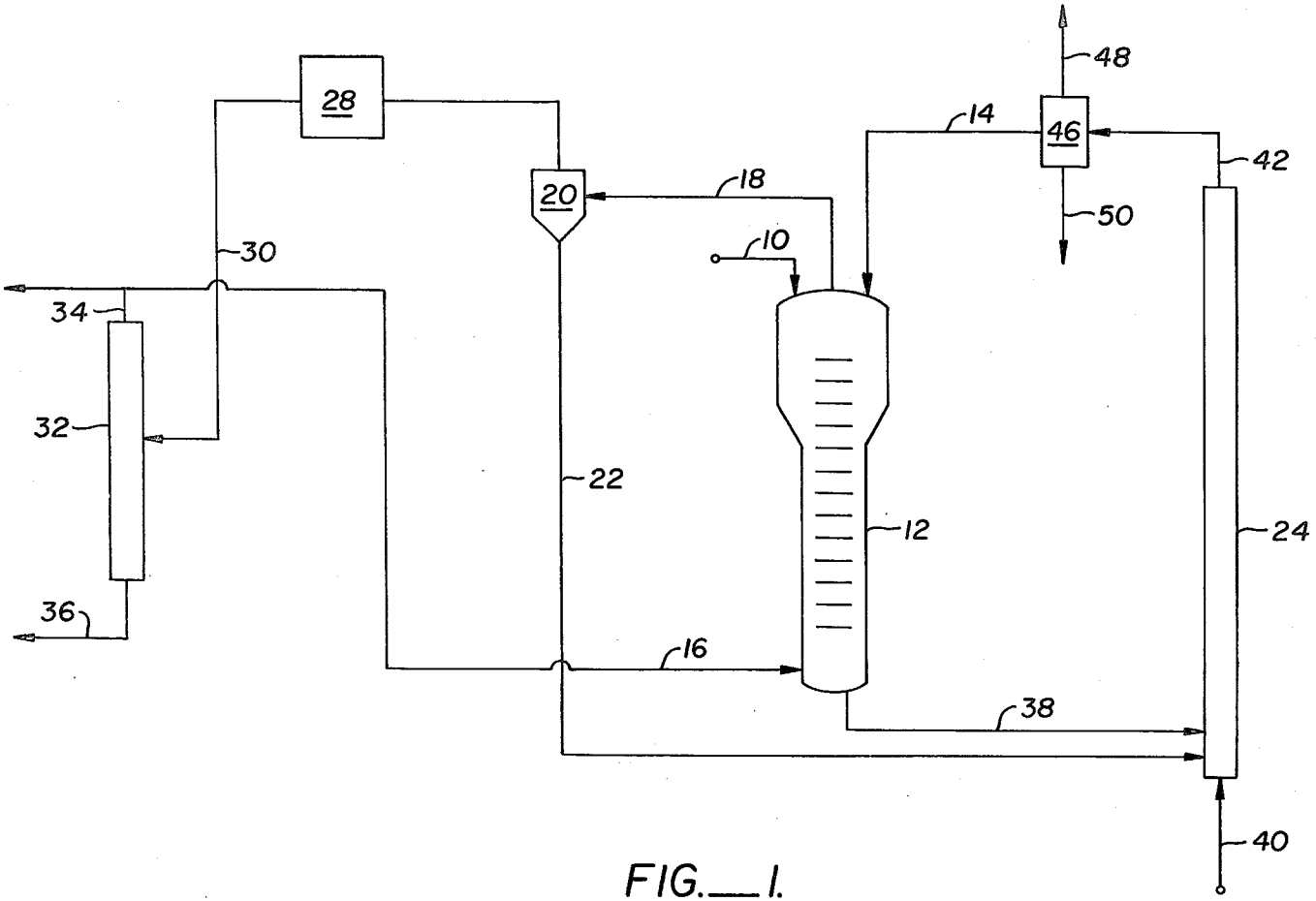
FIG. 1 is a schematic flow diagram of one embodiment of apparatus and flow paths suitable for carrying out the process of the present invention in the retorting of shale.

Referring now to FIG. 1 of the drawings, raw shale particles and hot previously retorted shale particles are introduced through lines 10 and 14, respectively, into an upper portion of a vertically elongated retort 12 and pass downwardly therethrough. A stripping gas, substantially free of molecular oxygen, is introduced, via line 16, to a lower portion of retort 12 and is passed upwardly through the retort, fluidizing a portion of the shale particles. Hydrocarbonaceous materials retorted from the raw shale particles, stripping gas, and entrained fines are withdrawn overhead from an upper portion of retort 12 through line 18. The entrained fines are separated in zone 20 from the hydrocarbonaceous material and stripping gas and said fines pass via line 22 to a lower portion of combustor 24. Effluent retorted shale particles are removed from a lower portion of retort 12 through line 38 and also pass to the lower portion of said combustor.

The hydrocarbonaceous materials and stripping gas passing from zone 20 through line 26 are cooled in zone 28 and introduced as feed through line 30 to distillation column 32. In column 32 the feed is separated into a gaseous product and a liquid product which exit the column through lines 34 and 36, respectively. A portion of the gaseous product is recycled via line 16 to the retort to serve as stripping gas.

Air is introduced into a lower portion of combustor 24 through line 40 and provides oxygen to burn residual carbon on effluent retorted shale particles and the fines introduced thereto. The carbon combustion heats the previously retorted shale, which is removed with the flue gas from an upper portion of the combustor through line 42 and passes to separation zone 46. A portion of the heated previously retorted shale, preferably above 200 mesh, is recycled from separation zone 46 through line 14 to retort 12 to provide process heat. Hot flue gas and the remaining solids pass from separation zone 46 through lines 48 and 50, respectively.

B. Retort Solids and Stripping Gas

Figure 2:
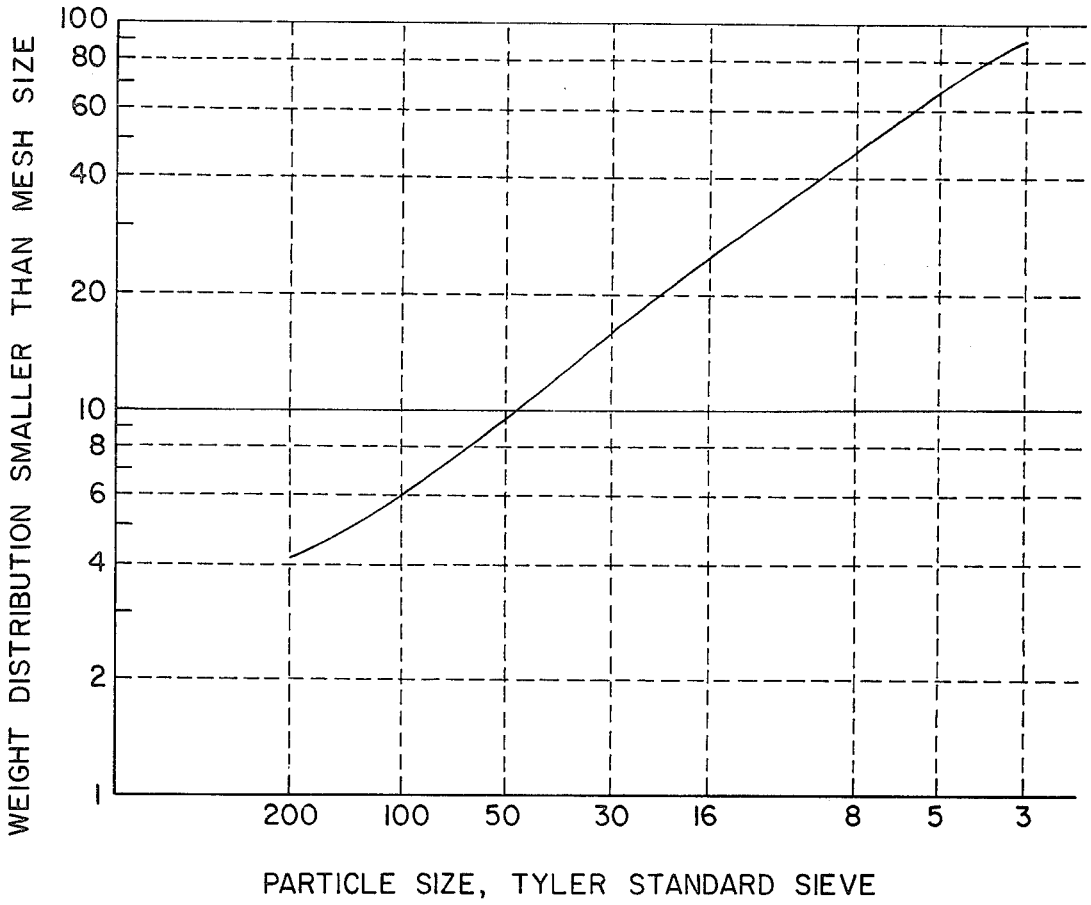
FIG. 2 graphically illustrates typical size distributions for crushed oil shale suitable for use in the present process.

Referring again to FIG. 1 of the drawings, crushed raw shale particles or other suitable hydrocarbon-containing solids are introduced through line 10 by conventional means, into an upper portion of a retort, generally characterized by reference numeral 12 and passed downwardly therethrough. Solid heat carrier particles at an elevated temperature, such as sand or previously retorted shale, are also introduced by conventional means through line 14 into the upper portion of said retort and pass downwardly therethrough cocurrently with the fresh crushed oil shale. The maximum particle size for the raw shale or heat carrier introduced is maintained at or below 2½ mesh, Tyler Standard Sieve size. Particle sizes in this range are easily produced by conventional means such as cage mills, jaw, or gyratory crushers. The crushing operations may be conducted to produce a maximum particle size, but little or no control is effected over the smaller particle sizes produced. This is particularly true in regard to the crushing of shale which tends to cleave into slab or wedged-shape fragments. An example of particle size and weight distribution for shale processed by a jaw crusher, such that 100% of the shale wll pass through a 2½ Tyler mesh screen, is shown in FIG. 2 of the drawings. As shown therein, the maximum particle size is 2 ½ mesh but substantial quantities of smaller shale particles, typically ranging down to 200 mesh and below, are also produced. Shale particles having such a relatively broad size distribution are generally unsuitable for moving bed retorts since the smaller shale particles fill the interstices between the larger shale particles, thereby resulting in bridging of the bed and interrupted operations. Therefore, it is normally required to separate most of the fines from crushed shale prior to processing in a moving bed retort. This procedure naturally results in additional classification expenses as well as diminished resource utilization.

Such particle sizes are also unsuitable for use in conventional fluidized beds since, for a given gas velocity, only a portion of the particles will fluidize and higher gas velocities sufficient to fluidize the larger shale particles will cause entrainment of the smaller particles. Furthermore, the partial fluidization attained is highly unstable, tending to channel or slug.

The temperature of the spent shale introduced to the retort via line 14 will normally be in the range of 1100° F.–1500° F., depending upon the selected operating ratio of heat carrier to shale. The fresh shale may be introduced at ambient temperature or preheated if desired to reduce the heat transfer required between fresh shale and heat carrier. The temperature at the top of the retort should be maintained within the broad range, 850° F. to 1000° F., and is preferably maintained in the range of 900° F. to 950° F.

The weight ratio of spent shale heat carrier to fresh shale may be varied from approximately 1.5:1 to 8:1 with a preferred weight ratio in the range of 2.0:1 to 3:1. It has been observed that some loss in product yield occurs at the higher weight ratios of spent shale to fresh shale and it is believed that the cause for such loss is due to increased adsorption of the retored hydrocarbonaceous vapor by the larger quantities of spent shale. Furthermore, attrition of the spent shale, which is a natural consequence of retorting and combustion of the shale, occurs to such an extent that high recycle ratios cannot be achieved with spent shale alone. If it is desired to operate at the higher weight ratios of heat carrier to fresh shale, sand may be substituted as part or all of the heat carrier.

The mass flow rate of fresh shale through the retort should be maintained between 1000 lb/hr-ft$^2$ and 6000 lb/hr-ft$^2$, and preferably between 2000 lb/hr-ft$^2$ and 4000 lb/hr-ft$^2$. Thus, in accordance with the broader recycle heat carrier weight ratios stated above, the total solids mass rate will range from approximately 2,500 lb/hr-ft$^2$ to 54,000 lb/hr-ft$^2$. These mass flow rates are significantly greater than the rates obtainable under existing retort processes.

A stripping gas is introduced, via line 16, into a lower portion of the retort and passes upwardly through the vessel in countercurrent flow to the downwardly moving shale. The flow rate of the stripping gas should be maintained to produce a superficial gas velocity at the bottom of the vessel in the range of approximately 1 foot per second to 5 feet per second, with a preferred superficial velocity in the range of 1 foot per second to 2 feet per second. Stripping gas may be comprised of steam, recycle product gas, hydrogen or any insert gas. It is particularly important, however, that the stripping gas selected be essentially free of molecular oxygen to prevent product combustion within the retort.

C. Plug Flow

The stripping gas will fluidize those particles of the raw shale and heat carrier having a minimum fluidization velocity less than the velocity of the stripping gas. Those particles having a fluidization velocity greater than the gas velocity will pass downwardly through the retort, generally at a faster rate than the fluidized particles. An essential feature of the present invention lies in limiting the maximum bubble size and the vertical backmixing of the downwardly moving shale and heat carrier to produce stable, substantially plug flow conditions through the retort volume. True plug flow, wherein there is little or no vertical backmixing of solids, allows much higher conversion levels of kerogen to vaporized hydrocarbonaceous material than can be obtained, for example, in a fluidized bed retort with gross top to bottom mixing. In conventional fluidized beds or in stirred tank type reactors, the product stream removed approximates the average conditions in the conventional reactor zone. Thus, in such processes partially retorted material is necessarily removed with the product stream, resulting in either costly separation and recycle of unreacted materials, reduced product yield, or a larger reactor volume. Maintaining substantially plug flow conditions by substantially limiting top to bottom mixing of solids, however, allows one to operate the process of the present invention on a continuous basis with a much greater control of the residence time of individual particles. The use of means for limiting substantial vertical backmixing of solids also permits a substantial reduction in size of the retort zone required for a given mass throughput, since the chances for removing partially retorted solids with the retorted solids are reduced. The means for limiting backmixing and limiting the maximum bubble size may be generally described as barriers, dispersers or flow redistributors, and may, for example, include spaced horizontal perforated plates, bars, screens, packing, or other suitable internals.

Bubbles of fluidized solids tend to coalesce in conventional fluidized beds much as they do in a boiling liquid. However, when too many bubbles coalesce, surging or pounding in the bed results, leading to a significant loss of efficiency in contacting and an upward spouting of large amounts of material at the top of the bed. The means provided herein for limiting backmixing also limits the coalescence of large bubbles, thereby allowing the size of the disengaging zones to be somewhat reduced.

All gross backmixing should be avoided, but highly localized mixing is desirable in that it increases the degree of contacting between the solids and the solids and gases. The degree of backmixing is, of course, dependent on many factors, but is primarily dependent upon the particular internals or packing disposed within the retort.

Solids plug flow and countercurrent gas contacting also permits maintenance of a temperature gradient through the vessel. This feature is one which cannot be achieved with a conventional fluidized bed due to the gross uniform top to bottom mixing.

D. Residence Time

Of great importance in the present invention is the interaction between the fluidized solids, the non-fluidized solids, and the means employed for preventing backmixing. The fluidized solids generally proceed down the retort of the present invention as a moving fluidized columnar body. Without internals, a stable fluidized moving bed could never be achieved with the proposed solids mixture. The means to limit backmixing, used in the present invention, significantly affect the motion of the non-fluidized particles and thereby substantially increase the residence time of said particles. The average velocity of the falling non-fluidized particles, which determines said particles' residence time, is substantially decreased by momentum transfer from the fluidized solids. This increased residence time thereby permits the larger particles to be retorted in a single pass through the vessel. It has been discovered that with some internals, such as horizontally disposed perforated plates spaced throughout the vessel, the residence time of the non-fluidized particles will closely approach the average particle residence time.

For example, minus 5 mesh shale particles, having a size distribution shown in Table 1, were studied in a 10" diameter by ten feet cold retort model equipped with horizontally disposed perforated plates having a 49% free area and spaced at 8 inch intervals. These studies revealed that the height equivalent to a perfectly mixed stage was approximately 6 inches. The perforated plates were then removed and 1 inch×1 inch wire grids, having a free area of 81%, were inserted in the retort at 4 inch spacings. Further studies on the modified retort using identical shale feed and the same fluidization gas velocity revealed that the height equivalent to a perfectly mixed stage was approximately 26 inches.

The residence time of the larger non-fluidizable shale particles (approximately 5 mesh) was measured using radioactively tagged particles. The residence times were approximately 95% of the average particle residence time with the perforated plates and 75% of the average particle residence time with the wire grids.

TABLE 1

| Particle Size, Tyler Standard Sieve | Percent Weight Distribution |
|---|---|
| 5–8 | 25 |
| 8–12 | 13 |
| 12–25 | 25 |
| 25–50 | 14.5 |
| 50–100 | 7.5 |
| 100–200 | 5 |
| 200– | 10 |

E. Stripping

As a result of the plug flow characteristics combined with the intense local mixing, the retort provides the equivalent of a serial plurality of perfectly mixed stages. The term "perfectly mixed stage" as used herein refers to a vertical section of the retort wherein the degree of solids mixing is equivalent to that attained in a perfectly mixed bed having gross top-to-bottom mixing. The number of equivalent perfectly mixed stages actually attained depends upon many inter-related factors, such as vessel cross-sectional area, gas velocity, particle size distribution and the type of internals selected to limit gross top-to-bottom backmixing. It is preferred that the retort provide the equivalent of at least four perfectly mixed stages.

Excellent stripping of the hydrocarbonaceous vapor from the retorted solids is uniquely achieved with the present invention. With the plug flow characteristics, the "lean" stripping gas first contacts those particles having the least amount of adsorbed hydrocarbonaceous material, thus maximizing the driving force for mass transfer of the hydrocarbonaceous vapor into the fluidization stream. In this respect the retort is quite analogous to a continuous desorption column.

Due to the hydrocarbon vapors evolved from the shale which mix with the stripping gas, the gas velocity increases along the length of the column. The actual amount of increases will depend upon the grade of shale processed and the mass rate of fresh shale per unit cross-sectional area, but may be minimized, if necessary, by proper initial design of the retort vessel. In this regard, the vessel may have an inverted frustoconical shape or may be constructed in sections of gradually increasing diameter.

The pressure at the top of the retort is preferably maintained no higher than that which is required to accomodate downstream. processing. The pressure in the bottom of the retort will naturally vary with the chosen downstream equipment, but will normally be in the range of 15–50 psig.

F. Product Recovery and Combustor Operation

A product effluent stream comprised of hydrocarbonaceous material admixed with the stripping gas is removed from the upper portion of the retort by conventional means through line 18 and passes to separation zone 20. Since the product effluent stream will normally contain some entrained fines, it is preferred that said fines be separated from the remainder of the stream prior to further processing. This separation may be effected by any suitable or conventional means, such as cyclones, pebble beds and/or electrostatic precipitators. Preferably the fines which are separated from the product effluent stream pass via line 22 to a combustor, generally characterized by reference numeral 24. Product effluent, free of fines, passes from the separation zone via line 26. At this juncture, conventional and well-known processing methods may be used to separate normally liquid oil product from the product effluent stream. For example, the stream could be cooled by heat exchange in cooling zone 28 to produce steam and then separated into its normally gaseous and liquid components in distillation column 32. A portion of the gaseous product leaving the distillation column, via line 34, may be conveniently recycled to retort 12, via line 16, for use as stripping gas. If preferred, the gas may be preheated prior to return to the retort or introduced at the exit temperature from the distillation column. The remainder of the product gas passes to storage or additional processing and the normally liquid product is withdrawn from column 32 via line 36.

The retorted shale along with the spent shale serving as heat carrier is removed from the lower portion of the retort via line 38 by conventional means at the retort temperature. The retorted shale will have a residual carbon content of approximately 3 to 4 weight percent and represents a valuable source of energy which may be used to advantage in the process. From line 38 the retorted shale and spent shale are fed to a lower portion of combustor 24. While combustor 24 may be of conventional design, it is preferred that same be a dilute phase lift combustor. Air is injected into the lower portion of the combustor via line 40 and the residual carbon on the shale is partially burned. The carbon combustion heats the retorted shale to a temperature in the range of 1100° F. to 1500° F. and the hot shale and flue gas are removed from the upper portion of the combustor via line 42 and passed to separation zone 46. A portion of said hot shale is recycled via line 14 to provide heat for the retort. Preferably said recycled shale is classified to remove substantially all of the minus 200 mesh shale prior to introduction to the retort to minimize entrained fines carryover in the effluent product vapor. Hot flue gases are removed from the separation zone via line 48 and waste spent solids are passed from the zone via line 50. The clean flue gas and/or spent solids passing from zone 46 via lines 48 and 50 may be used to provide heat for steam generation or for heating process streams.

What is claimed is:

1. In a retorting process wherein fresh hydrocarbon-containing solid particles are retorted by passing said particles into an upper portion of a vertically elongated retort and downwardly therethrough, heating said fresh hydrocarbon-containing solid particles in said retort to retorting temperatures sufficiently high to drive off hydrocarbonaceous materials from said fresh hydrocarbon-containing solid particles, removing said hydrocarbonaceous materials from an upper portion of said retort, and withdrawing the resulting retorted particles from a lower portion of said retort, the improvement which comprises:

(a) maintaining a non-oxidizing atmosphere in said retort;

(b) accomplishing said heating of said fresh hydrocarbon-containing particles primarily by heat transfer to said fresh hydrocarbon-containing particles of heat from hot solid heat carrier particles;

(c) passing said hot solid heat carrier particles into an upper portion of said retort;

(d) passing a non-oxidizing gas upwardly through said retort from a lower portion thereof, at a gas velocity between 1 foot/second and 5 feet/second;

(e) maintaining the size of both said fresh hydrocarbon-containing particles and said heat carrier particles passed into said retort in a size range which includes particles which are fluidizable at said gas velocity and particles which are non-fluidizable at said gas velocity;

(f) passing said fluidizable fresh hydrocarbon-containing particles and said fluidizable heat carrier particles downwardly through said retort as a downwardly moving columnar bed of particles fluidized by and in countercurrent contact with said upwardly passing gas, at a first rate low enough for the residence time of said fluidizable particles in said retort to be at least sufficient for substantially complete retorting of said fluidizable fresh hydrocarbon-containing particles in said retort;

(g) passing said non-fluidizable fresh hydrocarbon-containing particles and said non-fluidizable heat carrier particles downwardly through said retort and through said columnar bed of particles of countercurrent contact with said upwardly passing gas, at a second rate faster than said first rate and slow enough for the residence time of said non-fluidizable fresh hydrocarbon-containing particles in said retort to be sufficient for at least substantial retorting of said non-fluidizable fresh hydrocarbon-containing particles in said retort;

(h) substantially limiting backmixing and slugging of the fluidizable and non-fluidizable particles in said retort by passing said downwardly moving fluidizable and non-fluidizable particles through a plurality of dispersers disposed in the interior of said retort, said dispersers being constructed and disposed in said retort such that stable fluidization of said fluidizable particles is maintained and such that the residence time of said non-fluidizable particles is increased;

(i) withdrawing from an upper portion of said retort said gas in admixture with hydrocarbonaceous materials driven from said fresh hydrocarbon-containing particles in said retort and stripped from the retorted hydrocarbon-containing particles by said gas; and (j) withdrawing from said lower portion of the retort effluent solids including said resulting retorted hydrocarbon-containing particles and said heat carrier particles.

2. A process as recited in claim 1, wherein the fresh hydrocarbon-containing particles are hydrocarbon-containing particles selected from the group consisting of shale, tar sand, gilsonite and coal.

3. A process as recited in claim 1, wherein the heat carrier particles are comprised of previously retorted hydrocarbon-containing particles.

4. A process as recited in claim 1, wherein the heat carrier is comprised of sand and previously retorted hydrocarbon-containing particles.

5. A process as recited in claim 1 wherein solid fines are entrained in said upwardly passing gas in admixture with said gas and said hydrocarbonaceous materials mixed with said gas, and are withdrawn with said gas from the upper portion of said retort.

6. A process as recited in claim 1, wherein said non-oxidizing gas is selected from the group consisting of gas withdrawn from said retort and recycled thereto, steam, hydrogen, and inert gas.

7. A process as recited in claim 1, further comprising:

passing a portion of said effluent solids, including particles containing residual carbonaceous material into a combustion zone separate from said retort;

contacting said effluent solids in said combustion zone with an oxygen-containing gas under conditions which result in burning at least a portion of said carbonaceous material thereby heating said effluent solids;

withdrawing at least a portion of said heated effluent solids from said combustion zone; and introducing said portion of said heated effluent solids into said upper portion of said retort as said heat carrier particles.

8. A process as recited in claim 1, wherein said dispersers are perforated plate separators disposed transversely in said retort at spaced intervals.

9. A process as recited in claim 1, wherein said dispersers are screens disposed transversely in said retort at spaced intervals.

10. A process as recited in claim 1, wherein said dispersers are rods disposed transversely in said retort at spaced intervals.

11. A process as recited in claim 1, wherein said dispersers are packing substantially filling said retort.

12. A process as recited in claim 1, wherein the residence time of the non-fluidizable particles is at least 50% of the average residence time for all particles passing through said retort.

13. A process as recited in claim 1, wherein the residence time of the non-fluidizable particles is at least 90% of the average residence time or all particles passing through said retort.

14. A process as recited in claim 1 wherein the equivalent of at least two perfectly mixed serial stages is provided in said retort.

15. A process as recited in claim 1 wherein the equivalent of at least four perfectly mixed serial stages is provided in said retort.

16. A process as recited in claim 7, wherein substantially all of the heated effluent solids introduced to said retort are above 200 mesh size.

17. In a retorting process wherein fresh hydrocarbon-containing solid particles are retorted by passing said particles into an upper portion of a vertically elongated retort and downwardly therethrough, heating said fresh hydrocarbon-containing solid particles in said retort to retorting temperatures sufficiently high to drive off hydrocarbonaceous materials from said fresh hydrocarbon-containing solid particles, removing said hydrocarbonaceous materials from an upper portion of said retort, and withdrawing the resulting retorted particles from a lower portion of said retort, the improvement which comprises:

(a) maintaining a non-oxidizing atmosphere in said retort;

(b) accomplishing said heating of said fresh hydrocarbon-containing particles primarily by heat transfer to said fresh hydrocarbon-containing particles of heat from hot solid heat carrier particles;

(c) passing said hot solid heat carrier particles into an upper portion of said retort;

(d) passing a non-oxidizing gas upwardly through said retort from a lower portion thereof, at a gas velocity between 1 foot/second and 5 feet/second;

(e) maintaining the size of both said fresh hydrocarbon-containing particles and said heat carrier particles passed into said retort in a size range which includes particles which are fluidizable at said gas velocity, particles which are non-fluidizable at said gas velocity and particles which are entrainable at said gas velocity;

(f) passing said fluidizable fresh hydrocarbon-containing particles and said fluidizable heat carrier particles downwardly through said retort as a downwardly moving columnar bed of particles fluidized by and in countercurrent contact with said upwardly passing gas, at a first rate low enough for the residence time of said fluidizable particles in said retort to be at least sufficient for substantially complete retorting of said fluidizable fresh hydrocarbon-containing particles in said retort;

(g) passing said non-fluidizable fresh hydrocarbon-containing particles and said non-fluidizable heat carrier particles downwardly through said retort and through said columnar bed of particles in countercurrent contact with said upwardly passing gas, at a second rate faster than said first rate and slow enough for the residence time of said non-fluidizable fresh hydrocarbon-containing particles in said retort to be sufficient for at least substantial retorting of said non-fluidizable fresh hydrocarbon-containing particles in said retort;

(h) substantially limiting backmixing and slugging of the fluidizable and non-fluidizable particles in said retort by passing said downwardly moving fluidizable and non-fluidizable particles through a plurality of dispersers disposed in the interior of said retort, said dispersers being constructed and disposed in said retort such that stable fluidization of said fluidizable particles is maintained and such that the residence time of said non-fluidizable particles is increased to at least 50% of the average residence time for all particles passing through said retort;

(i) withdrawing from an upper portion of said retort said gas in admixture with hydrocarbonaceous materials driven from said fresh hydrocarbon-containing particles in said retort and stripped from the retorted hydrocarbon-containing particles by said gas and the entrainable particles entrained in said gas in admixture with the hydrocarbonaceous materials;

(j) withdrawing from said lower portion of the retort effluent solids including said resulting retorted hydrocarbon-containing particles and said heat carrier particles.

* * * * *

UNITED STATES PATENT AND TRADEMARK OFFICE

CERTIFICATE OF CORRECTION

PATENT NO. : 4,199,432

DATED : April 22, 1980

INVENTOR(S) : Paul W. Tamm et al

It is certified that error appears in the above-identified patent and that said Letters Patent are hereby corrected as shown below:

Col. 1, line 19, "ranch efforts" should read --research efforts--.

Col. 8, line 40, "increases" should read --increase--.

Claim 13, Col. 11, line 31, "or all" should read --for all--.

Signed and Sealed this

*Second* Day of *September 1980*

[SEAL]

*Attest:*

SIDNEY A. DIAMOND

*Attesting Officer*

*Commissioner of Patents and Trademarks*